US005833434A

United States Patent [19]

Stahle

[11] Patent Number: 5,833,434

[45] Date of Patent: Nov. 10, 1998

[54] DEVICE FOR REGULATING THE OUTPUT OF A VERTICLE-AXIS CENTRIFUGAL PUMP

[75] Inventor: Carl Stahle, Neunkirch, Switzerland

[73] Assignee: Frideco AG, Neunkirch, Switzerland

[21] Appl. No.: 848,060

[22] Filed: Apr. 29, 1997

[30] Foreign Application Priority Data

Apr. 30, 1996 [CH] Switzerland ..... 1088/96

[51] Int. Cl.[6] ..... F04D 29/44; F04B 17/03

[52] U.S. Cl. ..... 415/205; 415/182.1; 415/203; 415/206; 415/208.1; 417/423.3; 417/424.1

[58] Field of Search ..... 415/24, 182.1, 415/203, 204, 205, 206, 208.1, 224; 417/423.3, 424.1

[56] References Cited

U.S. PATENT DOCUMENTS 91,580 6/1869 Timby ..... 415/205

4,880,352 11/1989 Aarestad ..... 415/208.1

FOREIGN PATENT DOCUMENTS 1046502 12/1958 Germany ..... 415/206

533 242 1/1973 Switzerland .

580 229 9/1976 Switzerland .

574140 12/1945 United Kingdom ..... 417/424.1

*Primary Examiner*—Christopher Verdier

*Attorney, Agent, or Firm*—Browdy and Neimark

[57] ABSTRACT

A suction port (2*a*) of the pump is submersed in an open-top cylindrical casing (3) coaxial to the impeller axis and equipped with a liquid inlet pipe (4) tangentially discharging the liquid into the casing in the direction of the impeller rotation. The lower portion of the cylindrical casing wall (3*d*) and/or the liquid inlet pipe (4) is designed in the form of a channel or pipe following a radius with center inside the casing, so that the swirling flow generated inside the casing (3), and the inlet flow that enhances said swirling flow, are concentrated and their liquid levels dynamically forced into a vertical level.

10 Claims, 2 Drawing Sheets

DEVICE FOR REGULATING THE OUTPUT OF A VERTICLE-AXIS CENTRIFUGAL PUMP

FIELD OF THE INVENTION

The present invention pertains to a device for regulating the output of constant-speed vertical-axis centrifugal pumps.

REVIEW OF RELATED TECHNOLOGY

In lifting stations with fluctuating quantities of water to be lifted, for example municipal wastewater or rainwater, a simple device serves to regulate the output according to the varying quantities of accumulating liquid, without requiring adjustment of the revolutions of the pump, by providing for a functional design of the pump sump.

The device comprises an open-top cylinder placed in the suction sump, having an inlet opening tangential to the direction of rotation of the pump, ending above the bottom of the cylinder; and a coaxial suction pipe, the upper end of which is attached to the suction side of the pump, projecting into the cylinder. This device is described in the Swiss Patent 533 242.

If enough water has accumulated for the water line to rise sufficiently high above the edge of the cylinder, the water flows over said edge into the cylinder and straight to the suction pipe of the pump, without resulting in a noticeable difference in the water levels inside and outside the cylinder; and the pump thus achieves its full output according to its characteristic curve. If the quantity of accumulating water decreases, less and less water can flow over the edge of the cylinder, and the water level inside the cylinder drops below the water level outside the cylinder. This results in increasing quantities of water entering the cylinder through the tangential inlet opening, causing a swirling movement of the water inside the cylinder that accelerates as the difference between the water levels increases. This resulting swirling flow in the direction of rotation of the pump causes a proportionate reduction in the output of the pump, so that the output is adjusted to the respective reduced quantity of accumulating water. With this method, the output of a pump can be reduced from 100% to approximately 50%. The lowest lifting level is predetermined by the cross-section of the tangential inlet opening.

To expand the regulating range to a lower quantity, the tangential inlet opening was replaced by a downward sloped channel extending from a point slightly below the level of the cylinder edge and tangentially protruding through the cylinder wall. The lowest lifting level was thus no longer limited by the entrance cross section of a pipe; however, in practical application it was found that the inlet flow tangentially entering the swirling flow via the channel produced an undesirable effect. Air entrapped due to waves and cross-currents, entering the suction pipe of the pump, caused unexpected disruptions in the output flow of the pump.

SUMMARY OF THE INVENTION

Accordingly, the present invention has an object, among others, to overcome deficiencies in the prior art such as noted above.

The present invention is aimed at improving the above device so as to attain a smooth flow that is free from cross-currents and is not subject to unexpected disruptions and to attain a substantially lower minimum output.

In the present invention the gyroscopic movement, of both the inlet flow and also the swirling flow of the liquid inside the casing, are intensified before they are forced together, so that the current of the tangential inlet flow forces the transported medium against the outer wall of the inlet channel in the form of a coaxial spiral prior to discharging it into the cylindrical casing, thus placing the open liquid level in a roughly vertical level.

The swirling liquid inside the cylindrical casing, in turn, also forms a vertical surface when it crosses the inlet opening in the casing wall and is forced together, at an acute angle, with the above-described approximately vertical liquid level of the inlet flow, whereby said inlet flow accelerates the swirling flow inside the casing without causing any cross-currents. The gyroscope movement inside the casing is further intensified and concentrated in the same direction based on the formation of a channel in the cylindrical casing wall at the height of the suction opening, or the pump suction port, respectively, that is coaxially encased by the suction opening, with the upper wall of the channel reducing the diameter of the casing to a small diameter.

In this manner all floating matter, such as scum and liquids with a lighter specific weight, can be suctioned off by the pump in a larger stable area before the output flow is disrupted. This self-cleaning effect is utilized especially in wastewater pumping stations to reduce undesirable odors and eliminate the need for purification efforts.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF THE PREFERRED EMBODIMENT

Figure 1:
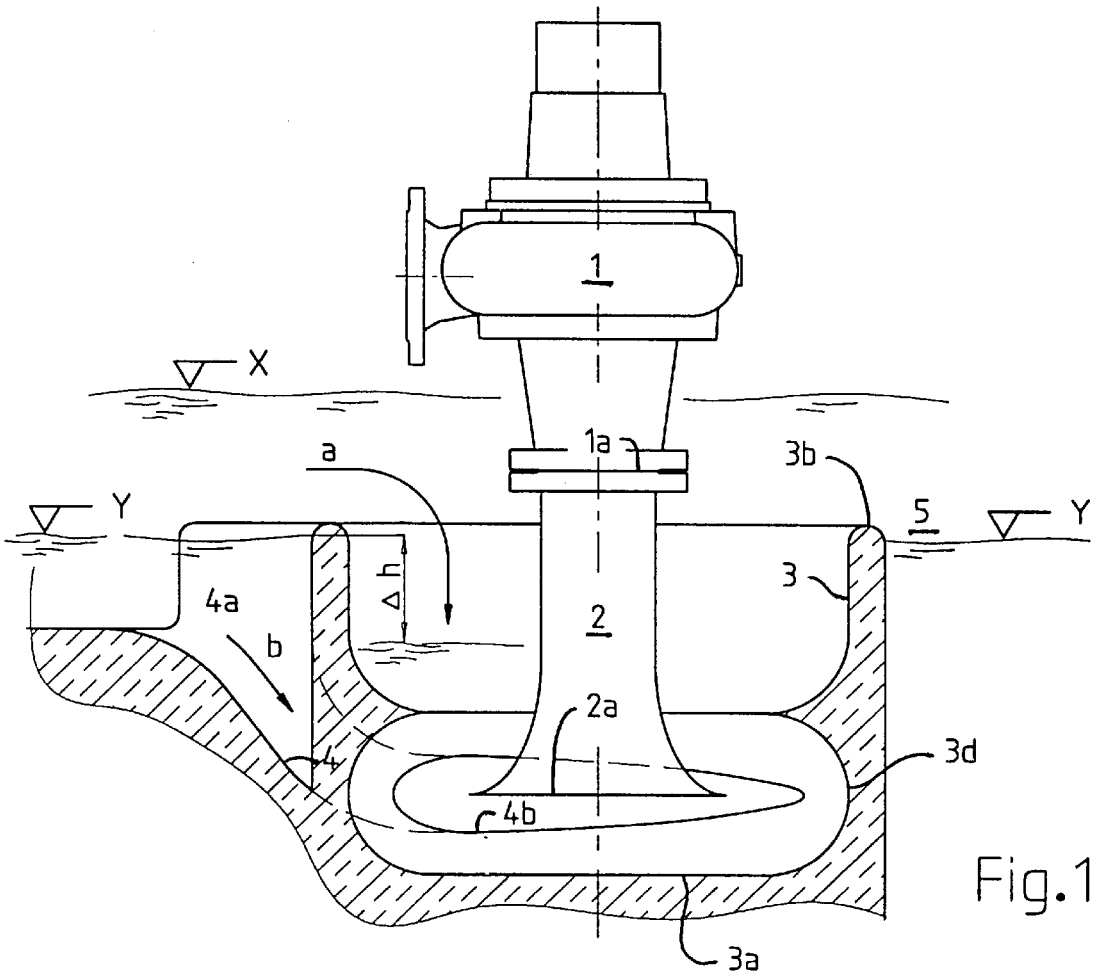
FIG. 1 is a vertical section, along the line I—I in FIG. 2, through a centrifugal pump with a volume control device between 100% and a mean control range.
Figure 2:
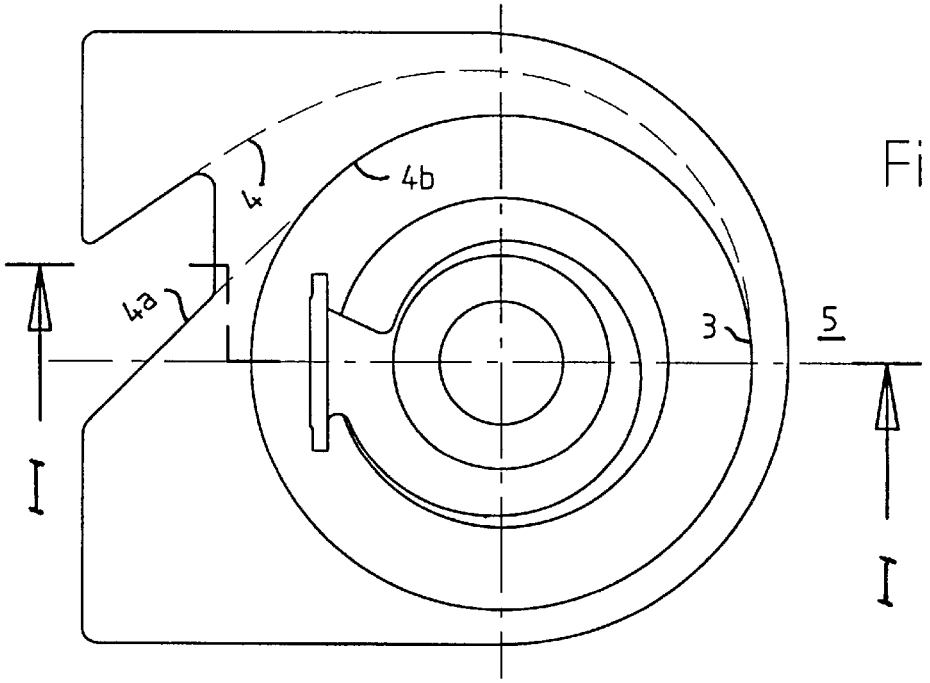
FIG. 2 is a plan view of FIG. 1.

The vertical-axis, end-suction circumferential pump 1 shown in FIG. 1 and 2, has a suction pipe 2 connected to the suction connection 1*a*, with the flared, non-attached suction opening 2*a* of the suction pipe 2 located at a distance above the bottom 3*a* of a cylinder 3 that coaxially encompasses the suction pipe 2 at a radial clearance. At the height of the pump suction port of the suction opening 2*a*, an inlet pipe 4 tangential to the direction of rotation of the pump 1 opens into the wall of the cylinder 3. A channel 4*a*, sloping downward from a higher elevation, is formed in the wall of the cylinder 3, penetrating the same in the area 4*b* and forming the inlet opening into the inlet pipe 4.

When the liquid level X in the suction sump 5 is high, the channel 4*a* and the upper edge 3*b* of the cylinder are sufficiently flooded so that the transported medium inside the cylinder 3 flows to the suction opening 2*a* in the direction of the arrow a, without any noticeable drop in pressure, where it is suctioned off by the pump 1 operating at its maximum output based on its characteristic curve.

If the inflow quantity decreases, the liquid level drops from X to Y. In the process, less and less water can flow over the cylinder edge 3*b*, causing the liquid level inside the cylinder 3 to drop even lower than the level inside the suction sump 5 and resulting in a difference of level δh from the level Y in the suction sump 5. As a result, increasing quantities of liquid enter the cylinder 3 via the tangential inlet pipe 4, causing an intensifying swirling movement of the liquid inside the cylinder, in the direction of the pump rotation. This decrease in the relative velocity inside the impeller results in a reduced output of the pump, until the output corresponds to the accumulating quantity of liquid.

Figure 4:
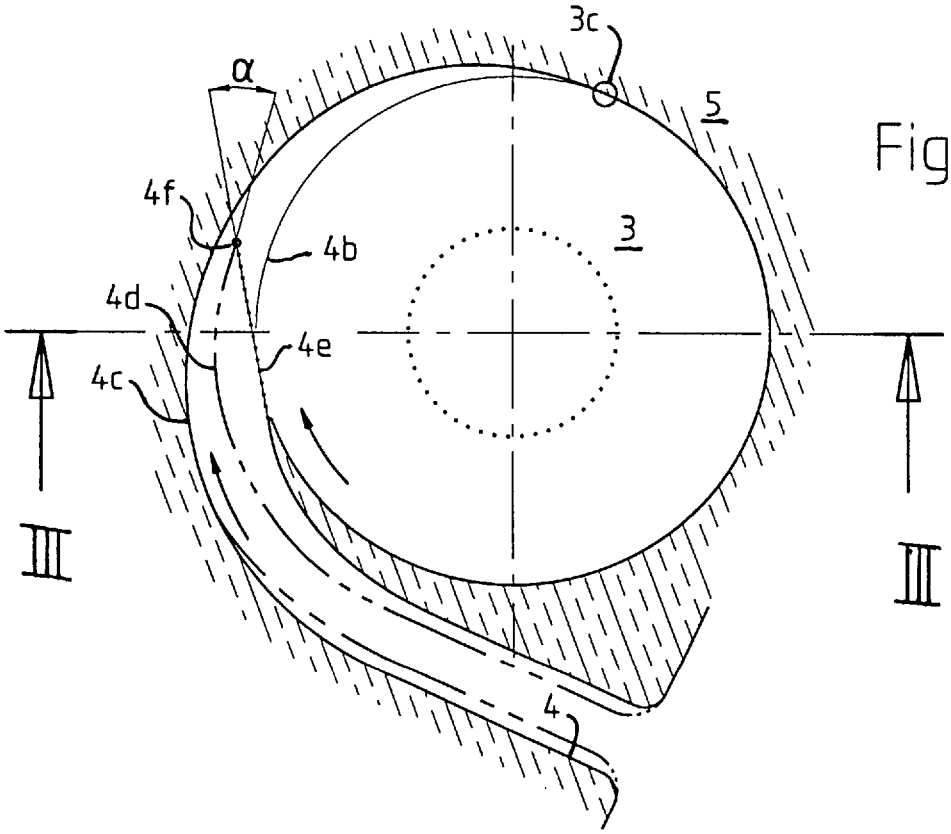
FIG. 4 is a horizontal section, along the line III—III in FIG. 3, illustrating the minimum output.

If the accumulating quantity of liquid decreases even further, a partial filling of the entrance cross-section of the inlet pipe 4 results, which, in the case of a straight-line discharge of the flow, would produce turbulence in the liquid ring swirling inside the cylinder, and result in air entrapments, which is prevented by the following means: In FIG. 4, the boundary lines of the jet flow of the entering liquid are shown in the form of lines of alternating long and double short dashes. The inlet pipe spirals downward at an incline (helically) to the lower portion of the cylinder 3, and penetrates the wall 4*b* of said cylinder. The outer wall 4*c* of the inlet pipe 4 continues to spiral downward in the form of a channel to the end of the penetration area at point 3*c* and discharges through the cylinder wall in a tangential direction. The liquid that enters through the inlet pipe 4, is subjected to a centrifugal force in the curved section 4*c* of the outer wall, causing the liquid to be forced against the outer wall 4*c* of the pipe, so that the inner, open level 4*d* of the liquid is located in an approximately vertical position.

The liquid swirling inside the casing, marked with a line of separated close dots, crosses the suction pipe section 4*b* with its outer open level of the liquid, as shown by the knotted line of dots strung along a line (forming a straight flow). The inlet flow with its level 4*d* and the swirling flow with its outer level 4*e* are united, free of turbulence, at an acute angle α at the point 4*f*, providing for an optimum transfer of the energy from the inlet flow to the swirling flow.

Figure 3:
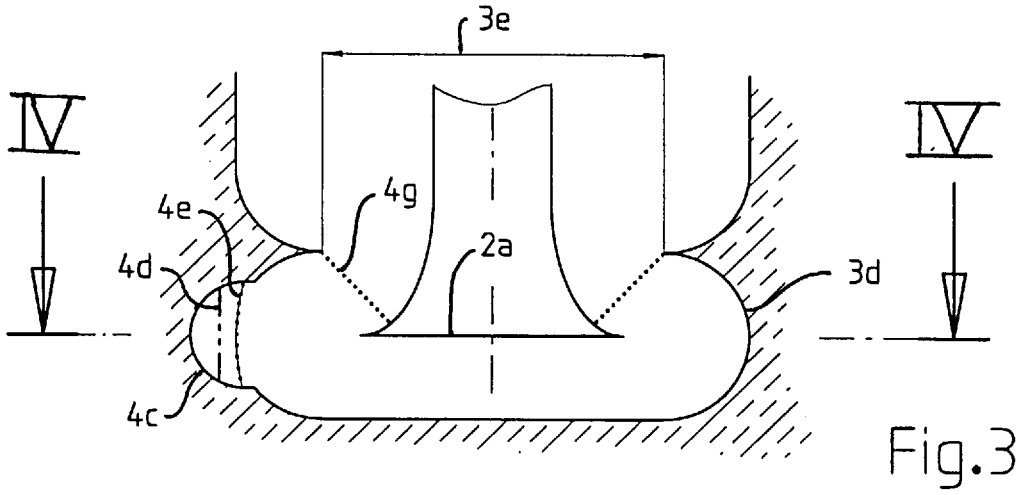
FIG. 3 is a vertical section along the line IV—IV in FIG. 4, for a volume regulation down to the minimum range.

The effect of concentrating the flow and enhancing the swirling movement is intensified by the design of the lower cylinder wall at the height of the suction opening 4*b*, or suction port 2*a*, respectively, in the form of a channel 3*d*, the upper wall of which reduces the diameter of the cylinder 3 to a small diameter 3*e* and stabilizes the lowest liquid level with its open inner level 4*g*, both regarding position and angle, and prevents air from unpredictably entering into the suction opening 2*a*. The upper wall of the casing 3, which reduces the diameter of the casing to a smaller diameter 3*e*, includes a lip (seen as a circle in FIG. 2 and as a cusp in FIGS. 1 and 3). Below this lip the channel 3*d* preferably is shaped as a portion of a toroid, as seen in the drawing. A toroid defines a central geometric axis, which is denoted herein as a channel center.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. In a device for regulating output of a constant-speed centrifugal pump having a vertical pump impeller axis and being of the type including a suction port (2*a*) of the pump being submersed in a cylindrical casing (3) having an open top and the cylinder diameter and being coaxial to a pump impeller axis and a liquid inlet line (4) tangentially entering the casing and oriented in the direction of the impeller rotation, the improvement wherein:

an inlet line lower portion of the liquid inlet line (4) comprises a horizontal spiral, having a generating center inside the casing to produce swirling flow inside the casing (3), so that inlet flow is concentrated and a liquid level thereof is dynamically forced into an at least approximately vertical level.

2. The improvement according to claim 1, wherein the liquid inlet line lower portion slopes downward from a higher level (Y) to a casing lower portion of the casing (3) and then becomes horizontal, and penetrates a lower portion of said casing (3) in the direction of impeller rotation.

3. The improvement according to claim 2, wherein a curvature radius of the liquid inlet line lower portion entering into the casing (3) comprises means for a surface of the liquid (4*d*) to be aligned to the at least approximately vertical level due to centrifugal force, and is joined with an outer level (4*e*) of the swirling flow at an acute angle.

4. The improvement according to claim 3, wherein the inlet line lower portion comprises a pipe in the lower portion of the casing (3).

5. The improvement according to claim 1, wherein the casing (3) comprises a channel (3*d*) formed by an upper wall disposed below the open top the channel defining a channel center; and wherein the channel center is substantially coincident with the impeller axis.

6. In a device for regulating an output of a constant-speed centrifugal pump having a vertical impeller axis and being of the type including the pump having a suction port (2*a*) being submersed in a cylindrical casing (3) having an open top and a cylinder diameter and being coaxial to the pump impeller axis;

the improvement comprising:

a liquid inlet line (4) tangentially entering the casing and oriented in a direction of impeller rotation; and wherein a lower portion of the casing (3) comprises a channel (3*d*) having a channel center inside the casing;

wherein the channel (3*d*) comprises an upper wall in the casing (3) disposed below the open top and reducing a diameter of the casing (3) to a small diameter (3*e*) less than the cylinder diameter;

whereby swirling flow inside the casing (3) causes a swirling liquid surface to become substantially vertical.

7. The improvement according to claim 6, wherein the channel (3*d*) comprises a substantially toroidal portion coaxially curving around the pump suction port (2*a*) generally at the height of said pump suction portion.

8. The improvement according to claim 7, wherein the liquid inlet line (4) slopes downward from a higher level (Y) to the lower portion of the casing (3) and then becomes horizontal, and penetrates a lower portion of said casing (3) in the direction of impeller rotation.

9. The improvement according to claim 8, wherein a lower portion of the liquid inlet line (4) comprises a horizontal spiral, having a generating center inside the casing to produce swirling flow inside the casing (3).

10. The improvement according to claim 9, wherein the inlet line (4) penetrates the casing (3) such that an outer wall (4*c*) of the inlet (4) continues to spiral around the generating center inside the casing (3), whereby the inlet forms a smaller outer channel of decreasing depth in the cylinder wall and tangentially transitions into the casing.

* * * * *